United States Patent [19]

Artwick et al.

[11] Patent Number: 4,897,975

[45] Date of Patent: Feb. 6, 1990

[54] INTEGRAL DOOR LIGHT WITH GLAZING STOP

[75] Inventors: Kert E. Artwick, Holland; Steven R. Wilkening, Wyoming, both of Mich.; Leslie L. Pallin, Prescott, Wis.

[73] Assignee: ODL, Incorporated, Zeeland, Mich.

[21] Appl. No.: 113,739

[22] Filed: Oct. 23, 1987

[51] Int. Cl.[4] ..... E06B 3/58

[52] U.S. Cl. ..... 52/208; 52/773; 52/775; 52/780

[58] Field of Search ..... 52/208, 397, 400, 402, 52/403, 395, 455, 456, 775, 780, 781, 773; 49/DIG. 1

[56] References Cited

U.S. PATENT DOCUMENTS

| | | | |
|---|---|---|---|
| 557,148 | 3/1896 | Rapp . | |
| 809,145 | 1/1906 | Sjobring . | |
| 986,013 | 3/1911 | Klemm . | |
| 988,574 | 4/1911 | Jones . | |
| 1,000,094 | 8/1911 | Klemm . | |
| 1,009,089 | 11/1911 | Nellis . | |
| 1,021,053 | 3/1912 | Lempera . | |
| 1,039,292 | 9/1912 | Johnson . | |
| 1,124,660 | 1/1915 | Rapp . | |
| 1,150,132 | 8/1915 | Lempera . | |
| 1,185,705 | 6/1916 | Nyman . | |
| 1,203,311 | 10/1916 | Connell . | |
| 1,270,014 | 6/1918 | Conwell . | |
| 1,391,949 | 9/1921 | Gogay . | |
| 1,466,650 | 8/1923 | Peterson . | |
| 1,574,493 | 2/1926 | Leonard . | |
| 1,601,519 | 9/1926 | Young . | |
| 1,620,451 | 3/1927 | Ellison et al. . | |
| 1,799,423 | 4/1931 | Hubbert . | |
| 1,857,076 | 5/1932 | Zenker . | |
| 2,336,999 | 12/1943 | Peelle . | |
| 2,505,553 | 4/1950 | Krantz | 52/773 |
| 2,605,869 | 8/1952 | Backman . | |
| 2,710,994 | 6/1955 | Mills . | |
| 2,747,705 | 5/1956 | Bagnard . | |
| 3,004,641 | 10/1961 | Johnson . | |
| 3,096,861 | 7/1963 | Frick et al. . | |
| 3,153,817 | 10/1964 | Pease, Jr. . | |
| 3,205,630 | 9/1965 | Felix et al. . | |
| 3,245,124 | 4/1966 | Faske . | |
| 3,299,596 | 1/1967 | Neal et al. . | |
| 3,458,955 | 8/1969 | Brooks . | |
| 3,462,897 | 8/1969 | Weinrott . | |
| 3,487,601 | 1/1970 | James | 52/400 |
| 3,487,602 | 1/1970 | Braun et al. . | |
| 3,490,178 | 1/1970 | Voisin . | |
| 3,504,471 | 4/1970 | Aspaas | 52/400 |
| 3,576,092 | 4/1971 | Halpern . | |
| 3,631,630 | 1/1972 | Buffington et al. . | |
| 3,697,633 | 10/1972 | Edgar . | |
| 3,714,751 | 2/1973 | Lackey . | |
| 3,881,290 | 5/1975 | Bouchey | 52/398 |
| 3,982,371 | 9/1976 | Preu | 52/773 |
| 4,084,347 | 4/1978 | Brown . | |
| 4,084,361 | 4/1978 | Aspaas . | |
| 4,152,876 | 5/1979 | Seely . | |
| 4,266,487 | 5/1981 | Marulic et al. . | |
| 4,327,535 | 5/1982 | Governale . | |
| 4,409,767 | 10/1983 | Jentoft et al. . | |
| 4,430,836 | 2/1984 | McKann . | |
| 4,525,966 | 7/1985 | Litchfield | 52/397 |
| 4,527,368 | 7/1985 | Jentoft . | |
| 4,546,585 | 10/1985 | Governale . | |
| 4,555,884 | 12/1985 | van Eerden | 52/397 |
| 4,589,238 | 5/1986 | Sampson et al. . | |
| 4,640,078 | 2/1987 | Haffer | 52/731 |
| 4,733,510 | 3/1988 | Werner | 52/202 |

FOREIGN PATENT DOCUMENTS

| | | | |
|---|---|---|---|
| 900279 | 5/1972 | Canada | 52/775 |
| 2320703 | 11/1974 | Fed. Rep. of Germany | 52/773 |
| 2321974 | 11/1974 | Fed. Rep. of Germany | 52/773 |
| 2258510 | 8/1975 | France . | |
| 706698 | 5/1966 | Italy | 52/775 |
| 424179 | 11/1964 | Switzerland | 52/775 |

*Primary Examiner*—Henry E. Raduazo

[57] ABSTRACT

The specification discloses a door light including a frame incorporated structurally into the door and a glass removable from the frame. The frame is fabricated of coextruded members each having a coextruded seal of lower durometer. Removable glass retainers or glazing stops are snap-fitted within the frame to retain the glass against the seal. Preferably, the glass retainers are biased against the glass to improve the seal and to accommodate glasses having slight thickness variations.

13 Claims, 3 Drawing Sheets

FIG. 1
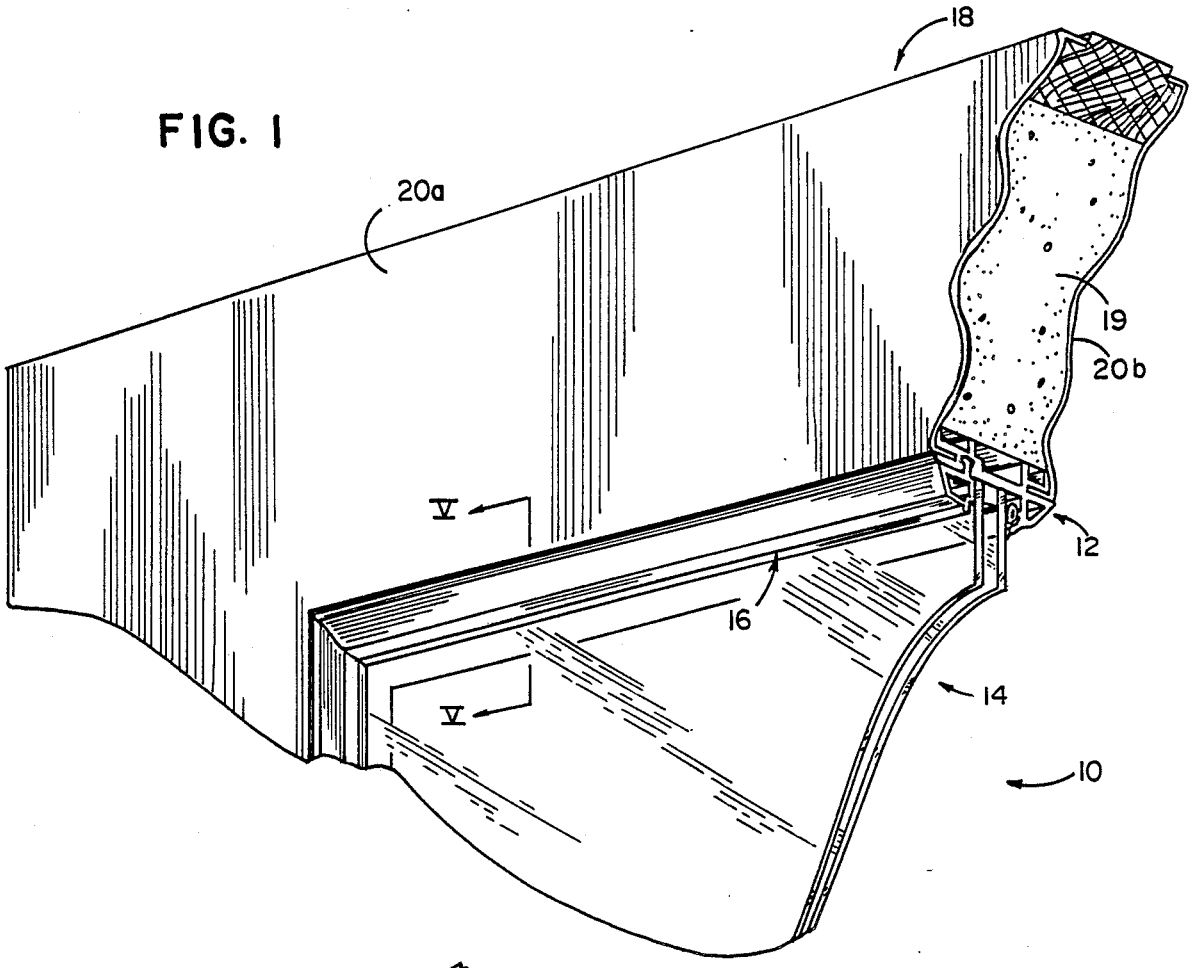
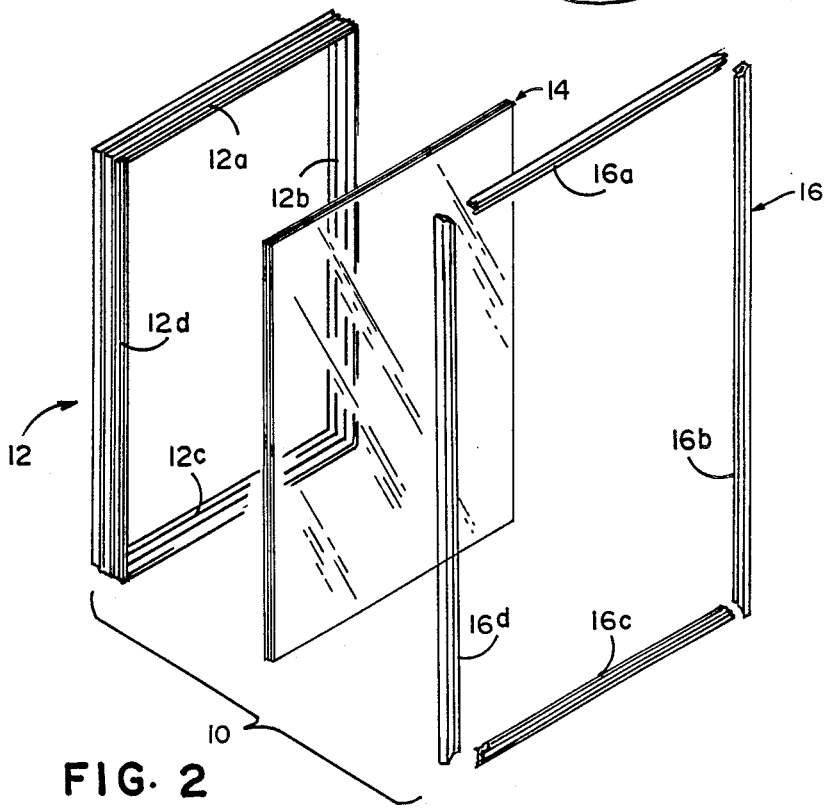
FIG. 2

FIG. 6
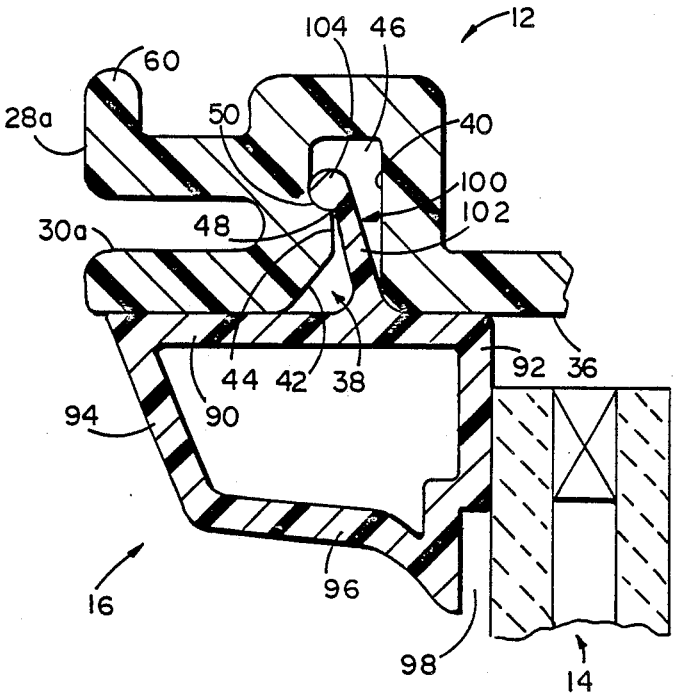
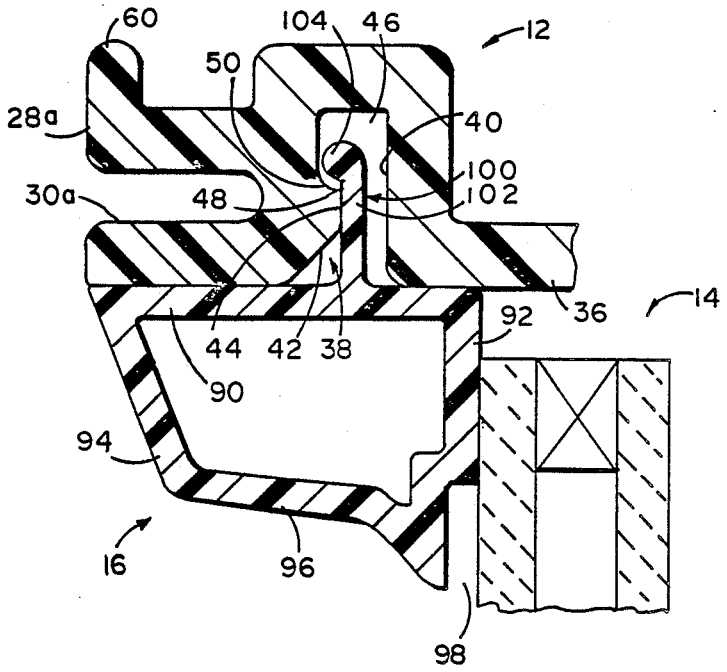
FIG. 7

INTEGRAL DOOR LIGHT WITH GLAZING STOP

BACKGROUND OF THE INVENTION

The present invention relates to door lights and more particularly to "integral door lights" wherein the door light frame is incorporated structurally into the door.

A door light is a window assembly especially adapted to be mounted within a door. Typically, the door light and door blank are manufactured separately from one another. The door light is subsequently mounted within the door blank by removing a portion of the door blank to form an opening and then mounting the door light within the opening. Typically, the door light includes inner and outer frames which engage the opposite sides of the door to sandwich the door blank therebetween.

Recently, "patio doors" have gained increasing popularity as an alternative to the traditional sliding door. The patio door is a hinged door supporting a door light extending the majority of the height and width of the door. Mounting traditional door lights in patio doors is undesirable for a number of reasons. First, the traditional manufacturing method is wasteful of material since the majority of the door blank must be removed and discarded to receive the door light. Second, the door light frame protrudes from both sides of the doors resulting in an undesirable bulky appearance.

As a consequence, "integral door lights" have been developed. "Integral door light" means any door light wherein the frame is specially adapted to structurally interfit with the remaining door components during manufacture to support the frame within the door.

Examples of integral door lights are illustrated in U.S. Pat. No. 4,546,585 issued Oct. 15, 1985 to Governale entitled DOOR PANEL AND METHOD OF MAKING and U.S. Pat. No. 4,327,535 issued May 4, 1982 to Governale entitled DOOR WITH GLASS PANEL. In both patents, the door light frame is assembled about the glass prior to manufacture of the door. The door light frame is then entrapped between the opposite steel jackets or skins of the door to maintain the door light in position. Specifically, a lip extends inwardly from both jackets to interfit with a groove in the door light frame. Following manufacture, the door light frame comprises an integral portion of the door construction and cannot be removed without substantially destroying the door. Therefore, the door light glass cannot be removed from the door subsequent to manufacture for replacement in case of breakage, scratching, or fogging.

SUMMARY OF THE INVENTION

The aforementioned problems are overcome in the present invention wherein an integral door light frame is provided enabling the glass to be easily removed for servicing subsequent to manufacture. More specifically, the door light includes a frame to be structurally incorporated within the door, a glass or other glazing panel mounted within the frame, and a plurality of glazing retainers or stops for securing the glass panel in the frame. The glazing stops are releasably secured to the frame enabling the stops to be relatively easily removed subsequent to assembly, permitting the glass panel to be removed for servicing or replacement as necessary.

In a first preferred embodiment of the invention, the removable glass retainers include a spring structure for biasing the glass retainers toward the glass panel in a direction generally perpendicular to the plane of the glass panel. This maintains the glass panel in firm contact with the frame and also permits the door light frame to accommodate glasses having slight thickness variations. In a second preferred embodiment of the invention, the frame includes an integral seal for sealing the exterior glass surface thereagainst. Most preferably, the seal is coextruded with the frame. The frame therefore provides an integral weather-proof seal to prevent the infiltration of water and/or air and to eliminate the need for separate glazing materials or compounds.

These and other objects, advantages, and features of the invention will be more readily understood and appreciated y reference to the detailed description of the preferred embodiment and the drawings.

BRIEF DESCRIPTION OF THE DRAWINGS

FIG. 1 is a fragmentary perspective view of the present door light mounted with a door;

FIG. 2 is a perspective exploded view of the door light;

FIG. 6 is an enlarged fragmentary sectional view of the glazing stop in one extreme position; and FIG. 7 is a fragmentary sectional view of the glazing stop in its other extreme position.

DETAILED DESCRIPTION OF THE PREFERRED EMBODIMENT

Figure 3:
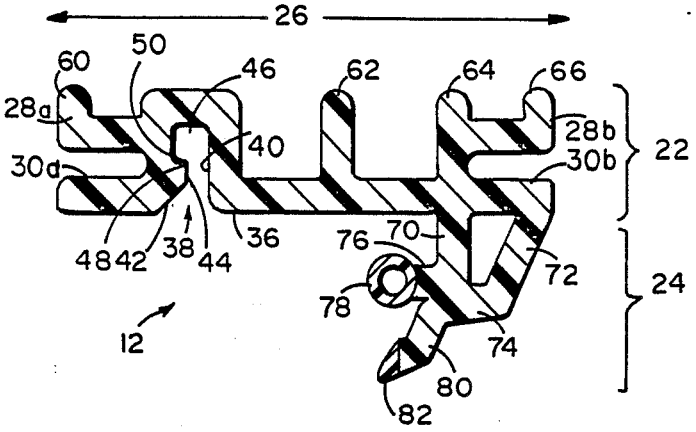
FIG. 3 is a sectional view of the frame.

A door light constructed in accordance with a preferred embodiment of the invention is illustrated in the drawings and generally designated 10. The door light includes a frame 12, a glass panel or glazing panel 14, and a plurality of glazing stops or glass retainers 16. The door light lo is supported within a door 18; and more particularly, the steel skins 20*a* and 20*b* of the door extend into grooves in the frame 12 as will be described. The glass retainers 16 are removable from the frame 12 permitting the glass panel to be readily and easily removed from the door for servicing and/or replacement.

Turning specifically to the construction of the door light 10, the frame 12 (FIG. 2) is generally rectangular and is fabricated of four linear extrusions 12*a, b, c,* and *d* all generally identical in cross section. The cross sectional configuration of each of the extrusions is illustrated in FIG. 3. The extrusion 12 includes a body portion 22 and a glass support portion 24. The body portion 22 has a width essentially identical to the core of the door 18 between the skins 20. The body portion 22 includes a pair of lateral opposite surfaces 28*a* and 28*b*. Grooves 30*a* and 30*b* extend generally perpendicularly through the lateral surfaces 28*a* and 28*b*, respectively, to receive the steel door skins 20 as will be described. The spacing legs 60, 62, 64, and 66 all terminate in a common plane to abut the core 19 of the door.

The body portion 22 of the frame extrusion 12 (FIG. 3) also defines a glass-edge-facing surface 36 which is generally planar and parallel to the grooves 30 and perpendicular to the lateral faces 28. A snap-channel 38 extends through the surface 36 and has a cross section shape generally similar to the capital letter R. The channel has a straight side 40 and an opposite beveled entry surface 42 leading to a restricted portion 44. The channel 38 terminates in an enlarged area 46. A snap ridge 48 delineates the restricted area 44 from the enlarged area 46. The portion 5 of the channel 38 immediately adjacent the snap ridge 48 within the enlarged area 46 is radiused defining a quarter circle to provide a pivot surface for the glazing stop spring flange as will be described.

The glass support portion 24 of the frame extrusion 12 (FIG. 3) is integral with the body portion 22 and is located on the "exterior" side of the frame facing away from the building interior. The frame extrusion 12 is generally L-shaped in cross section with the body portion 22 comprising a first leg of the L; while the glass support portion 24 comprises the second leg of the L. The walls 70 and 72 extend from the body portion 22 and are connected at their remote ends by wall 74 to define a generally trapezoidal cross section. A leg 76 extends from the wall 70 to support a coextruded bulb seal 78. A curvilinear leg 80 extends from the junction of walls 70 and 74 to support a coextruded compression seal 82.

Preferably, the frame extrusion 12 is fabricated of a plastic resin to eliminate conductive heat transfer from the interior side to the exterior side of the frame. The materials selected as the rigid and flexible portions of the extrusion 12 are preferably easily hot-knife weldable enabling the formation of corners which reduce air and water infiltration. In the presently preferred embodiment, the frame extrusion 12 is fabricated of a rigid polyvinyl chloride (PVC) of weatherable grade and having a durometer of 50 Shore D. The coextruded bulb seal 78 and compression seal 82 are fabricated of a flexible PVC of weatherable grade having a durometer of 64 Shore A. For aesthetic reasons, the rigid PVC is preferably white; while the flexible PVC is preferably black.

The four extrusion segments 12*a*, 12*b*, 12*c*, and 12*d* (FIG. 2) are interconnected to form the rectangular frame 12. Preferably, the corners are formed by miter cutting both ends of the four extrusion segments 12*a*, *b*, *c*, and *d* by hot-knife welding to provide a rigid structure and to provide a continuous weather-tight interconnection of the seals 78 and 82 at the frame corners.

Figure 5:
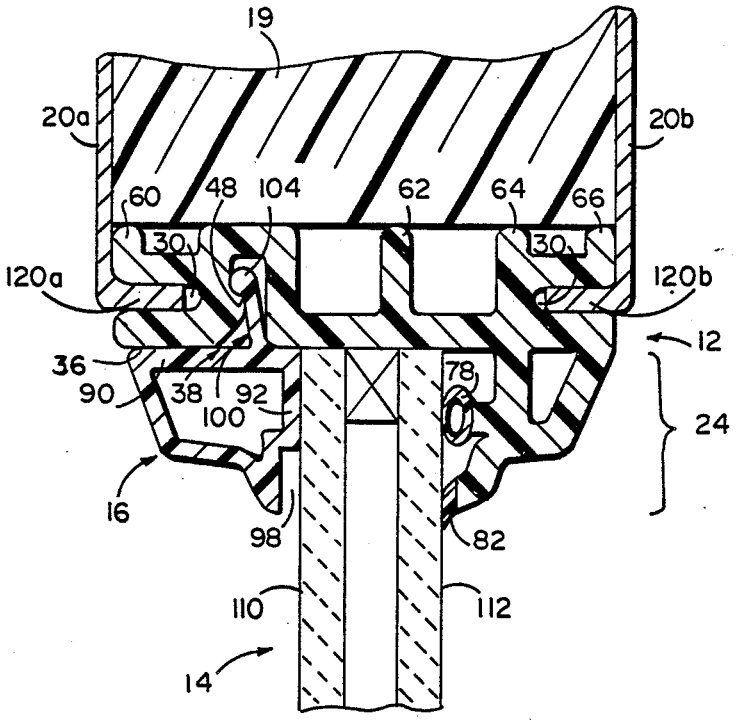
FIG. 5 is a sectional view taken along Plane V-V in FIG. 1.

As illustrated in FIG. 5, the frame 12 is secured in position by the steel skins 20*a* and 20*b*. As is conventional in door constructions, the steel skins 20*a* and *b* form the interior and exterior surfaces of the door 18. During manufacture of the door, the edges of the skins 20 are roll formed to create lips 120*a* and 120*b*, respectively. The lips 120 extend about the entire periphery of the frame 12; and each extends inwardly approximately one-quarter inch from the planar portion of the skins 20. The lips 120 are received within the channels 30 and thereby lock the body portion 22 between the two skins 20. The construction of the door, including the core 19, is conventional as illustrated for example in the previously identified U.S. Pat. Nos. 4,546,585 and 4,327,535.

Figure 4:
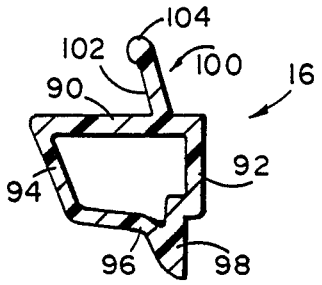
FIG. 4 is a sectional view of the glazing stop.

The glazing stops 16*a*, *b*, *c*, and *d* are all fabricated from a common extrusion and all have lengths slightly shorter than the corresponding extrusions 12*a*, 12*b*, 12*c*, and 12*d* to fit within the frame 12 and retain the glass panel 14 in position. The cross sectional configuration of the glazing stops or glass retainers 16 is illustrated in FIG. 4. The extrusion includes a base wall 90, a glass abutment wall 92, a trim wall 94, and a window grille wall 96. A notch or cut-out 98 is provided at the junction of the glass supporting wall 92 and the grille wall 96 permitting the tips of a window grille (not shown) to be inserted thereunder if desired.

A spring flange 100 extends from the base wall 90 of the glazing stop 16 at an acute angle of approximately 70 degrees. The spring flange 100 includes a body portion 102 terminating in a bulbous edge 104 generally circular in cross section. The diameter of the bulbous edge 104 is greater than the thickness of the spring flange 100. The width of the channel 38 is greater than the thickness of the spring flange body 102 permitting the body to pivot about the edge 104 to alter the position of the retainer 16.

The releasable intersecurement of the glazing stop 16 within the frame 12 is illustrated in FIGS. 5–7. The spring flange 100 is located within the channel 38 with the bulbous portion 104 located behind the snap ridge 48. The glazing stops are therefore located on the "interior" side of the frame facing the building interior. When the glazing stop 16 is fully inserted into the frame 12, the base wall 90 of the glazing stop lays against the surface 36 of the frame.

The glass panel 14 is of conventional construction and preferably is thermally insulated glass having an interior surface 110 and an exterior surface 112. The glass panel is positioned within the frame 12 such that the exterior surface 112 abuts and slightly compresses both the compression seal 82 and the bulb seal 78. The compression seal 82 is relatively narrow in a direction perpendicular to the glass panel 14 in comparison to the bulb seal 78. Consequently, the compression seal 82 bears the bulk of the pressure of the glass panel 14 against the glass support portion 24 to seal the exterior surface of the glass panel 14 against air and water infiltration. The glass panel 14 is retained in position by the glass support wall 92 cf the glazing stop 16 which bears against the interior surface 110 of the glass panel.

Assembly and Operation

Preferably, the door light 10 is fully assembled prior to manufacture of the door 18. The frame 12 is formed by interconnecting the four extrusion segments 12*a*, 12*b*, 12*c*, and 12*d* to define its rectangular shape. Preferably, the four corners are miter cut and hot-knife welded to provide rigid interconnections and continuity of seals at the corners. Other suitable corner fastening means can be used such as solvent or other adhesives.

The glass panel 14 is placed in the frame 12 with the exterior glass surface 112 (FIG. 5) abutting the compression seal 82 and the bulb seal 78. Both seals are continuous about the entire outer periphery of the frame 12 to form a continuous seal about the perimeter of the glass panel. Each glazing stop 16 is snap-pressed into the frame 12. Specifically, the spring flange 100 is guided into the channel 38. The beveled surface 42 facilitates guiding the spring flange into the channel. As the retainer is fully inserted, the bulbous edge 104 snaps behind the snap ridge 48 to provide a positive engagement of the retainer and to provide confirmation that the retainer has been properly installed. The spring flange 100 is flexed slightly during installation to bias the retainer 16 against the glass panel 14. The retainers 16 are mitered on their ends and meet one another in the corners of the frame 12. The retainers are not connected at their corners to facilitate assembly.

The spring flange 100, the compression seal 82, and the bulb seal 78 flex as necessary to accommodate glasses 14 having slightly varying thicknesses. FIGS. 6 and 7 illustrate the two extreme positions of the glazing retainer 16. FIG. 6 illustrates the position of the retainer 16 against a glass panel of relatively small thickness; while FIG. 7 illustrates the position of retainer 16 against a glass panel of greater thickness. In FIG. 6, the spring force of the spring flange 100 bearing against the snap ridge 48 forces the retainer 16 to the right extreme position as viewed in FIG. 6 and against the glass panel 14. Movement in the right direction is limited at the point wherein the spring flange 100 engages the frame 12. In FIG. 7, the greater thickness of the glass panel 14 forces the retainer to its left extreme position wherein the spring flange 100 is flattened against the surface 44 to be generally perpendicular to the base wall 90. Although the two extreme positions are illustrated in FIGS. 6 and 7, the glazing stop will normally assume a position therebetween for a given nominal glass panel thickness. This ability of the retainer 16 to accommodate glasses of different thicknesses permits minor variation in the thicknesses of the glass panel 14.

It is presently anticipated that the door will be fabricated with the door light 10 fully assembled. Alternatively, the door could be fabricated including the frame 12 alone with the glass panel 14 and retainers 16 being installed subsequently. In either case, a glazing compound (not shown) can be placed in the grooves 30 in the frame 12 to improve the seal between the skin lips 120 and the frame. The door can be fabricated as illustrated in the above cited patents.

The glazing retainers 16 can also be relatively easily removed from the frame 12 to permit the glass panel to be removed for servicing and/or replacement. To do so, the retainers 16 are moved in a direction parallel to the glass panel 14 so that the bulbous edge 104 rides over the snap ridge 48 enabling the spring flange 100 to be removed from the channel 38. With the described durometers, it is necessary to force a screwdriver between the frame 12 and the retainer 16 to provide leverage and the requisite force to remove the retainer from the frame. The same retainers can be reused over and over to retain the same glass panel 14 or a new replacement glass panel.

The above description is that of a preferred embodiment of the invention. Various alterations and changes can be made without departing from the spirit and broader aspects of the invention as set forth in the appended claims which are to be interpreted in accordance with the principles of patent law including the doctrine of equivalents.

The embodiments of the invention in which an exclusive property or privilege is claimed are defined as follows:

1. A door light comprising:

a rectangular frame including a plurality of one piece extruded members each being generally identical in cross section, each of said frame members including a body portion having an interfit means for interfitting with portions of a door to support said frame within the door, said body portion including a channel having a bottom, said channel being at least as deep as it is wide, each of said frame members further including a resiliently flexible seal portion extruded with said body potion, said seal portion having a durometer hardness lower than the durometer hardness of said body portion;

a glazing panel abutting said seal portion to seal said glazing panel about substantially the entire periphery of said frame; and a plurality of extruded glazing retainers snap-pressed within said frame, one glazing retainer being provided for each of said frame members, each of said glazing retainers including a body portion abutting said glazing panel to entrap said glazing panel in a position abutting said seal portion, each of said glazing retainers further including bias means for biasing said glazing retainer against said glazing panel to bias said glazing panel against said frame seal portion, said bias means including a spring flange extending from said body portion into said channel and terminating in an edge, said spring flange being longer than it is thick, said channel being wider than said flange is thick whereby said flange can move laterally within said channel, said bias means including a retainer means at said flange edge for retaining said spring flange within said channel, said spring flange being pivotal about said retaining means, whereby said flange can move within said channel to move said retainer body toward said glazing panel.

2. A door light as defined in claim 1 wherein said retainer means includes a bulbous edge on said spring flange and a snap ridge within said channel, said bulbous edge being in operative engagement with said snap ridge.

3. A door light as defined in claim 1 wherein said seal portion includes a compression seal and a bulb seal separate from said compression seal.

4. A door light as defined in claim 1 wherein said extruded glazing retainer defines a grille-receiving notch adjacent said glass and opening toward the central portion of said glass for receiving the terminal ends of a doorlight grille.

5. A door light as defined in claim 1 wherein each of said extruded members and each of said glass retainers include surfaces which engage and slide against one another as said spring flange moves within said channel.

6. A door light comprising:

a glass having exterior and interior surfaces;

a frame for supporting said glass, said frame including at least one one-piece frame member, said frame member including cooperating means for cooperating with a door to support said frame within the door, said frame member further including support means for engaging the exterior glass surface, said support means including a resiliently flexible seal engaged by said glass, said frame member further including a channel at least as deep as it is wide; and a glass retainer releasably secured to said frame member, said glass retainer including a glass engagement means for abutting said interior glass surface, said retainer further including bias means for biasing said glass engagement toward said glass and thereby maintaining said glass in contact with said resiliently flexible seal, said bias means including a spring flange longer than it is thick and retainer means for releasably retaining said spring flange within said channel, said spring flange pivoting about said retainer means, said channel being wider than said spring flange is thick so that said spring flange can move laterally within said channel and assume one of a variety of positions within said channel depending on the thickness of said glass, said movement of said spring flange being effective to move said retainer against said glass to maintain said glass in proper engagement with said seal and provide said retainer with the capacity to accommodate different glass thicknesses.

7. A door light as defined in claim 6 wherein said seal is integral with said support means.

8. A door light as defined in claim 7 wherein said seal is coextruded with said support means.

9. A door light as defined in claim 6 wherein said frame and said glass retainer include surfaces which engage and slide against one another as said spring flange moves within said channel.

10. A door light frame for supporting a glass within a door comprising:

a frame including a one-piece frame member, said frame member including a door interconnect portion for structurally cooperating with a door to support said frame member within the door, said frame member further including a glass support portion for supporting a glass in a plane, said glass support including a resiliently flexible sealing means for sealing the glass against said glass support portion, said frame defining a channel at least as deep as it is wide; and a glazing retainer snap-fitted to said frame member to retain the glass against said sealing means, said glazing retainer including bias means for biasing said glazing retainer toward the glass support portion of said frame, whereby glasses of varying thicknesses will be maintained in proper engagement with said sealing means, said bias means including a spring flange extending from said glazing retainer and terminating in an end remote from said retainer, said bias means further including retainer means for retaining said flange end within said channel, said flange pivoting about said retainer means, said channel being wider than said flange is thick so that said flange is permitted to move back and forth within said channel, said flange movement being effective to move said glazing retainer against said glass to maintain said glass in proper engagement with said sealing means and provide said retainer with the capacity to accommodate different glass thicknesses.

11. A door light frame as defined in claim 10 wherein both said frame and said glazing retainer are extruded.

12. A door light frame as defined in claim 11 wherein said sealing means is coextruded with said frame.

13. A door light frame as defined in claim 10 wherein said frame and said glass retainer include surfaces which engage and slide against one another as said spring flange moves within said channel.

* * * * *

UNITED STATES PATENT AND TRADEMARK OFFICE

CERTIFICATE OF CORRECTION

PATENT NO. : 4,897,975

DATED : February 6, 1990

INVENTOR(S) : Kert E. Artwick et al

It is certified that error appears in the above-identified patent and that said Letters Patent is hereby corrected as shown below:

Column 5, line 58:
delete "extruded" and insert --coextruded--

Column 5, line 58:
delete "potion" and insert --portion--

Column 6, line 11:
after including delete "a"

Signed and Sealed this

Fourth Day of December, 1990

*Attest:*

HARRY F. MANBECK, JR.

*Attesting Officer*

*Commissioner of Patents and Trademarks*